US010024156B2

(12) United States Patent
Webb et al.

(10) Patent No.: US 10,024,156 B2
(45) Date of Patent: Jul. 17, 2018

(54) METHOD OF MOVING A COMPONENT OR A MATERIAL TO AND WITHIN A LEVEL OF A SHAFT BORING SYSTEM

(71) Applicant: Technological Resources Pty. Limited, Brisbane (AU)

(72) Inventors: Rocky Lynn Webb, North Bay (CA); Fredric Delabbio, Samford (AU)

(73) Assignee: Technological Resources Pty. Limited, Melbourne (AU)

( * ) Notice: Subject to any disclaimer, the term of this patent is extended or adjusted under 35 U.S.C. 154(b) by 0 days.

(21) Appl. No.: 14/784,382

(22) PCT Filed: Apr. 16, 2014

(86) PCT No.: PCT/AU2014/000436
§ 371 (c)(1),
(2) Date: Oct. 14, 2015

(87) PCT Pub. No.: WO2014/169337
PCT Pub. Date: Oct. 23, 2014

(65) Prior Publication Data

US 2016/0053613 A1 Feb. 25, 2016

(30) Foreign Application Priority Data

Apr. 16, 2013 (AU) ..... 2013901328

(51) Int. Cl.
*E02D 5/12* (2006.01)
*E02D 7/02* (2006.01)
(Continued)

(52) U.S. Cl.
CPC ..... *E21D 5/12* (2013.01); *E21D 1/03* (2013.01); *E21D 7/02* (2013.01)

(58) Field of Classification Search
CPC .... E21D 1/03; E21D 5/12; E21D 7/02; B66B 17/14; B66B 17/16
(Continued)

(56) References Cited

U.S. PATENT DOCUMENTS 2,326,172 A * 8/1943 Riddell ..... E21D 1/03 212/327
3,123,240 A * 3/1964 MacAlpine ..... E02F 3/47 187/243
(Continued)

FOREIGN PATENT DOCUMENTS

CN 201567135 U 9/2010
DE 2528474 A1 * 1/1977 ..... B66B 17/20
(Continued)

OTHER PUBLICATIONS

Herrenhnecht AG: "Shaft Boring Machine SBM"—Retrieved from Internet on May 15, 2014.
(Continued)

*Primary Examiner* — Benjamin F Fiorello
*Assistant Examiner* — Stacy N Warren
(74) *Attorney, Agent, or Firm* — Banner & Witcoff, Ltd.

(57) ABSTRACT

A method of moving a component or a material to and within a level of a shaft boring system. The shaft boring system is positioned within a shaft and the method comprises lowering the component or the material inside a cage into the shaft and to a level of the shaft boring system. The method further comprises suspending the component or the material from a transport system within the level of the shaft boring system. In addition, the method comprises moving the component or the material within the level of the shaft boring system using the transport system. The component is a component of the shaft boring system and the material is a material for forming the shaft boring system.

19 Claims, 8 Drawing Sheets

(51) Int. Cl.
*E21D 5/12* (2006.01)
*E21D 1/03* (2006.01)
*E21D 7/02* (2006.01)

(58) Field of Classification Search
USPC ..... 405/133; 299/18, 19
See application file for complete search history.

(56) References Cited

U.S. PATENT DOCUMENTS

| | | | | | |
|---|---|---|---|---|---|
| 3,731,976 | A * | 5/1973 | Granskog | ..... | E21C 35/20 173/185 |
| 4,193,732 | A * | 3/1980 | Vetter | ..... | B66B 11/006 414/592 |
| 4,287,831 | A * | 9/1981 | Farkas | ..... | B61C 13/04 104/99 |
| 2012/0200139 | A1* | 8/2012 | Delabbio | ..... | E21D 1/06 299/18 |

FOREIGN PATENT DOCUMENTS

| | | | | | |
|---|---|---|---|---|---|
| DE | 2618237 | A1 * | 11/1977 | ..... | B61B 15/00 |
| JP | H04319199 | A | 11/1992 | | |
| JP | H11294063 | A | 10/1999 | | |
| WO | 2011/000037 | A1 | 1/2011 | | |

OTHER PUBLICATIONS

May 28, 2014—(WO) International Search Report and Written Opinion—PCT/AU2014/000436.

* cited by examiner

METHOD OF MOVING A COMPONENT OR A MATERIAL TO AND WITHIN A LEVEL OF A SHAFT BORING SYSTEM

CROSS-REFERENCE TO RELATED APPLICATIONS

The present application is a U.S. National Phase filing of International Application No. PCT/AU2014/000436, filed on Apr. 16, 2014, designating the United States of America and claiming priority to Australian Patent Application No. 2013901328 filed Apr. 16, 2013, and the present application claims priority to and the benefit of both the above-identified applications, which are incorporated by reference herein in their entireties.

FIELD OF THE INVENTION

The present invention relates to a method of moving a component or a material to and within a level of a shaft boring system and relates particularly, though not exclusively, to a method of moving the component to and within a work stage of the shaft boring system that is positioned in a mine shaft.

BACKGROUND OF THE INVENTION

International patent publication number WO 2011/000037A1 discloses a proposal for sinking a mine shaft in which earth excavated by a boring machine is transferred into large capacity conveyances in the form of skips which are raised and lowered by a hoisting system installed at the mine surface. On completion of shaft sinking operations the hoisting system and skips may subsequently be operated to convey material excavated during production mining.

In shaft sinking, services are lowered using buckets (attached by a sling) and transported to crews, waiting below to install the services on a shaft wall. This requires the crews to work under a suspended load, which is hazardous.

SUMMARY OF THE INVENTION

The present invention provides in a first aspect a method of moving a component or a material to and within a level of a shaft boring system, the shaft boring system being positioned within a shaft, the method comprising the steps of:

- suspending the component or the material from at least one elongated element of a transport system within the level of the shaft boring system; and
- moving the component or the material within the level of the shaft boring system along the transport system;
- wherein the component is a component for the shaft boring system or the shaft and the material is a material for forming the shaft boring system or the shaft.

The shaft boring system may comprise a Galloway or work stage. The shaft boring system may comprise a cutting head or cutting wheel. The cutting head or cutting wheel may be disposed below the Galloway or work stage. The level of the shaft boring system may be a level in the Galloway or work stage. The level in the Galloway or work stage may be configured (e.g. be of sufficient height) so that services components can be suspended from the transport system within the level. The level in the Galloway or work stage may be configured to that services piping can be suspended from the transport system within the level.

The component or the material may be suitable for installation or extension of services within the shaft. The step of lowering the component or the material may be conducted during sinking of the shaft. Further, the method may be conducted during installation of the shaft boring system.

The method may also comprise installing the component or the material at a location within the shaft. The component or material may comprise a services component and the method may comprise installing the services component in the shaft. The services component may be installed in or onto a lining of the shaft. The services component or material may comprise a pipe. The pipe may comprise a steel pipe. The pipe may comprise a vent duct.

The method may also comprise, before the suspending step, lowering the component or the material into the shaft and to the level of the shaft boring system. The lowering step may comprise lowering the component or the material in a cage. The step of lowering the component or the material inside the cage may comprise lowering a cage holder, such as a head section or "crosshead", with the cage into the shaft to a position at which the cage holder is stationary and then lowering the cage from the cage holder to a position suitable for accessing the component or the material from the level of the shaft boring system. The cage may travel with the cage holder along stage ropes above a Galloway or work stage. The cage may travel, without the cage holder, along guides within a Galloway or work stage. The guides within the Galloway or work stage may be fixed guides.

The cage holder may be a head section. The head section may be a crosshead.

The cage may comprise walls that partially or fully enclose the component or the material. Further, the cage may be one of a plurality of cages. In one specific example a first cage is positioned over a second cage. In an embodiment, the first cage is for transporting the component or material and the second cage is for transporting personnel. The first cage and second cage may be fixed together. The first cage may be adapted to receive a removable personnel cage.

The level of the shaft boring system may be a work stage below an upper deck of the shaft boring system and the step of moving the component or the material may comprise moving the component or the material within the work stage using the transport system.

In one embodiment the at least one elongated element is a rail and the transport system is a rail system, such as a monorail system. For example, a rail of the rail system may be attached (directly or indirectly) to the work stage of the shaft boring system. The rail system may be arranged to move the component or the material in a manner such that the component or the material is hanging below a portion of the rail system during movement.

In an alternative embodiment the transport system may comprise cables, for example horizontal cables, from which the component or the material is suspended using a suitable attachment system.

The step of suspending the component or the material from the transport system may comprise securing the component or the material using a sling, chain, trolley or the like. Further, the step of suspending the component or the material from the transport system may comprise lifting the component or the material to a height that is suitable for moving the component or the material within the work stage. Lifting the component or the material may comprise using a suitable lifting device, such as a manual, pneumatic, electric, or hydraulic hoisting device or a chain fall.

The step of moving the component or the material may comprise moving the component or the material within a work stage of the shaft boring system to an installation location of the shaft boring system positioned within a mine shaft, such as a wall of the mine shaft.

The step of moving the component or the material may also comprise moving the component or the material along a straight or curved path. Moving the component or the material may also comprise moving the component or the material from a first path section along a first direction to a second path section along a second direction that is different to the first direction.

The component may be of any suitable type, such as a pipe, a vent duct, a machine or any other material or part, such as a material or part that is required for the installation and extension of services within the shaft boring system. The component may also be one of a plurality of components.

The method may further comprise installing the transport system.

The cage may comprise a suspension element and the step of lowering the component or the material inside a cage may comprise suspending the component of the material from the suspension element while lowering the component or the material inside the cage.

The step of lowering the component to the level of the shaft boring system may comprise lowering the cage until the suspension element aligns with the transport system.

The present invention provides in a second aspect a system for moving a component or a material to and within a level of a shaft boring system for forming the shaft boring system or the shaft, the system comprising:

a transport system having at least one elongated element from which in use the component or the material is suspended to move the component or the material within the level of the shaft boring system.

The system may further comprise a hoisting system for lowering the component or the material into the shaft and to a level of the shaft boring system, the hoisting system comprising a cage arranged for receiving the component or the material, the hoisting system being arranged for lowering the cage into the shaft to a position suitable for accessing the component or the material from the level of the shaft boring system. The cage may comprise walls that partially or fully enclose the component or the material. Further, the cage may be one of a plurality of cages. In one specific example a first cage is in use positioned over a second cage.

The system may alternatively comprise a hoisting system for lowering the component or the material into the shaft and to a level of the shaft boring system, the hoisting system comprising a cage holder, such as a head section or "cross-head", with a cage arranged for receiving the component or the material, the hoisting system being arranged for lowering the cage holder with the cage into the shaft to a position at which the cage holder is stationary and then lowering the cage from the cage holder to a position suitable for accessing the component or the material from the level of the shaft boring system. The cage may comprise walls that partially or fully enclose the component or the material. Further, the cage may be one of a plurality of cages. In one specific example a first cage is in use positioned over a second cage.

The at least one elongated element may be a rail and the transport system may be a rail system, such as a monorail system.

The cage may comprise a suspension element for suspending the component or the material in the cage. The suspension element may align, in use, with the transport system when the cage is at the level of the shaft boring system The invention will be more fully understood from the following description of specific embodiments of the invention. The description is provided with reference to the accompanying drawings.

DETAILED DESCRIPTION OF SPECIFIC EMBODIMENTS

A mine shaft boring system of the type described in international patent publication number WO 2011/000037A1 comprises a boring head and an excavated material handling unit disposed above the boring head and operable to receive excavated material from the boring machine and to transfer it to skips for transport to a ground level and discharge at ground level to appropriate conveying equipment or other transport for disposal. Such a mine shaft boring system is extended or moved into the bore hole as boring progresses. For this purpose components of the mine shaft system need to be lowered into the mine shaft and then moved to an installation location within the shaft boring system.

Embodiments of the present invention relate to a method and an apparatus for moving components or materials, such as services, to and within a level of a shaft boring system (SBS). The services are transported inside a cage to an appropriate level on a Galloway, where the services are then picked up by a transport system, such as a monorail system, and moved to an installation location such as a position on the mine shaft wall for installation. Embodiments of the present invention have the advantage that the risk associated with working under loads and/or manhandling loads is reduced, and the movement of the services from the cage (transport device from surface) to their final installation location is accomplished by the use of suspension device (monorail). By providing a transport system to move components within a level of the shaft boring system, there is no need to move the work stage up and down to facilitate installation of services.

Figure 1:
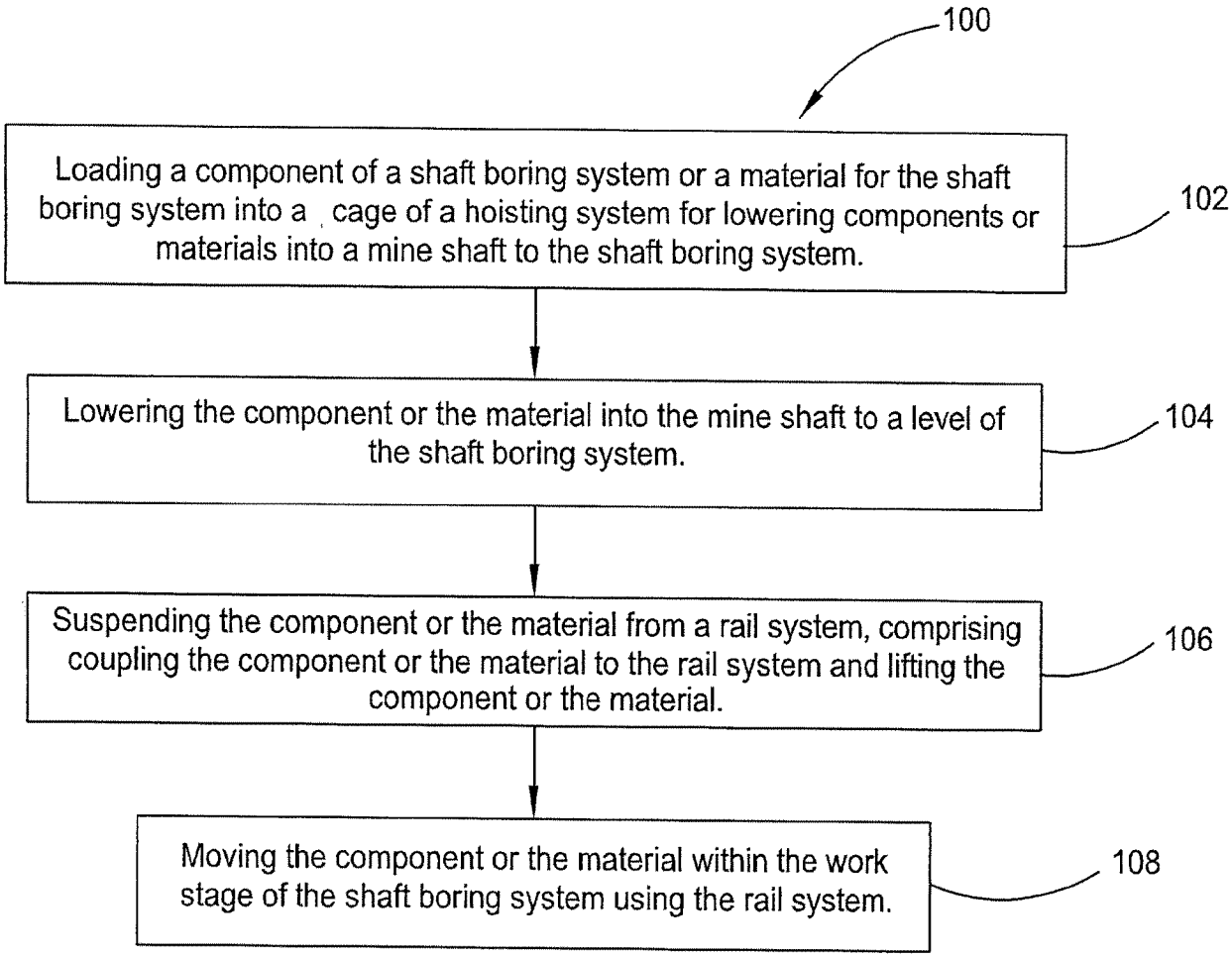
FIG. 1 is a flow chart of a method of moving a component to and within a level of a shaft boring system, in accordance with an embodiment of the present invention.

Referring now to FIG. 1, a method 100 of moving a component or a material to and within a level of a shaft boring system in accordance with an embodiment of the present invention is described. FIGS. 2-5 show regions of a shaft boring system 200 and illustrate movement of the component.

Embodiments of the method 100 move a component or a material 202 of the shaft boring system 200 within a work stage 204 of the shaft boring system 200 to an installation location 206 using a rail system, such as a monorail system 208. The monorail system 208 comprises in this embodiment tracks that are attached to the work stage 204. The tracks form a network of tracks such that various locations within the work stage 204 are accessible by the monorail system 208.

The shaft boring system 200 comprises a number of work stages and receiving stations at different levels (not shown).

At least some or all of the work stages may be equipped with monorail systems such as the monorail system 208.

A person skilled in the art will appreciate that the component or the material 202 may be of any suitable type. For example, the component or the material 202 may be a portion of a duct, a steel pipe, or a machine. Further, the component or the material 202 may be one of a plurality of components or materials that may be moved simultaneously.

The method 100 comprises the initial step 102 of loading the component or the material 202 (or a plurality thereof) into a cage 212 of a hoisting system 210 for lowering components into a mineshaft to the shaft boring system 200. Step 104 lowers the component or the material 202 into the mine shaft in which the shaft boring system 200 is positioned. The cage 212 with the component or the material 202 is received at a level 203. The step of lowering the component comprises lowering a cage holder ("cross-head") with the cage 212 to a first position and then lowering the cage 212 from the cage holder to the destination level. The first position may be the top of a Galloway or work stage. The destination level may be within the Galloway or work stage. In some embodiments, there may be no cage holder used during lowering of the cage. Instead, the cage may be able to be lowered from a position above the shaft boring system, into the shaft boring system, without the need for a cage holder. The cage holder and the cage 212 will be described in detail further below with reference to FIGS. 6 and 7.

Step 106 suspends the component or the material 202 from the monorail system 208. Step 106 also comprises unloading the component or the material 202 from the cage 212 of the hoisting system 210 and coupling the component or the material 202 to the monorail system 208. Coupling is performed using a coupling element such as a sling, chain fall or a suitable hoisting device, but the coupling element may alternatively also be provided in any other suitable form. Step 106 also comprises lifting the component or the material 202 using a lifting device to a height that is suitable for moving the component or the material 202 within the work stage 204. In this example the lifting device is provided in the form of a chain fall, or hoisting device 211.

Step 108 moves the component or the material 202 within the work stage 204 of the shaft boring system 200 using the monorail system 208. The component or the material 202 is decoupled from the monorail system 208 at an installation location 206 (such as a wall of the mine shaft) at which the component or the material 202 is installed.

The monorail system 208 may be arranged for movement of the component in any suitable direction of a succession of directions, such as partially around an axis of the shaft boring system 200.

Figure 2:
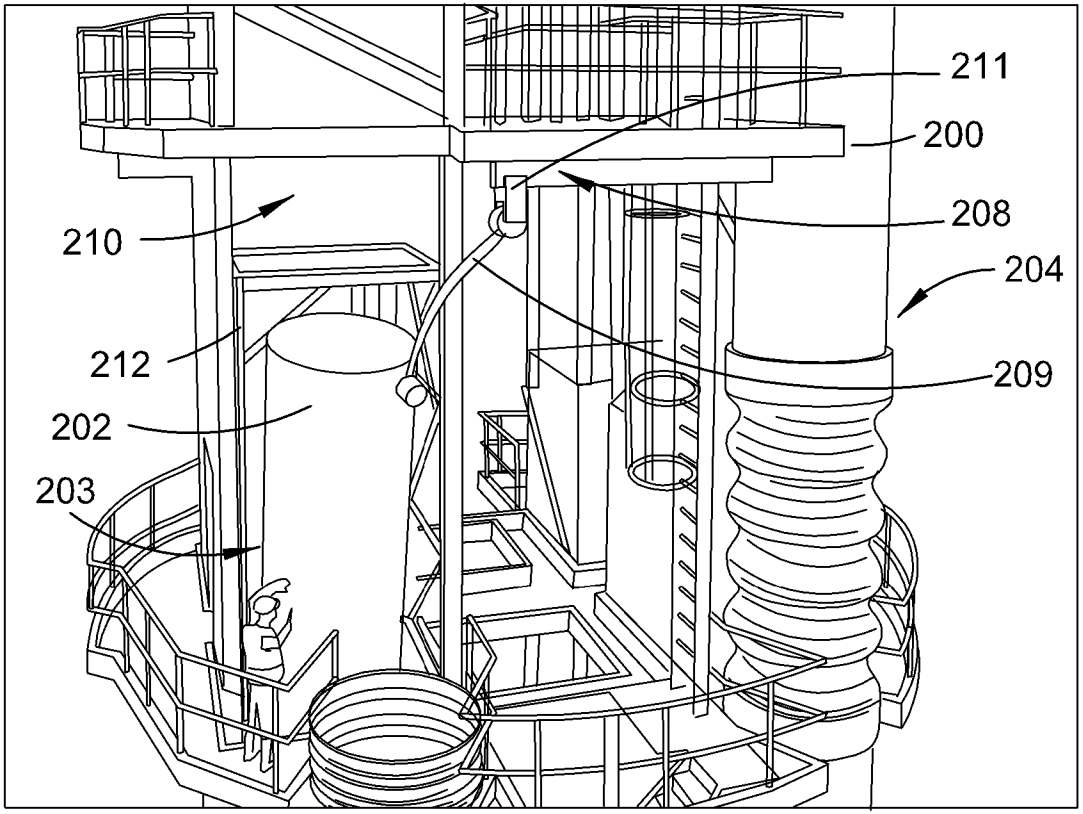
FIGS. 2-8 are schematic illustrations of regions and components of a shaft boring system in accordance with embodiments of the present invention.

FIG. 2 shows the component or the material 202 that is received at the work stage 204 of the shaft boring system 200. The sling, trolley, chain fall or hoisting device 209 is used to couple the component or the material 202 to the monorail system 208.

Figure 3:
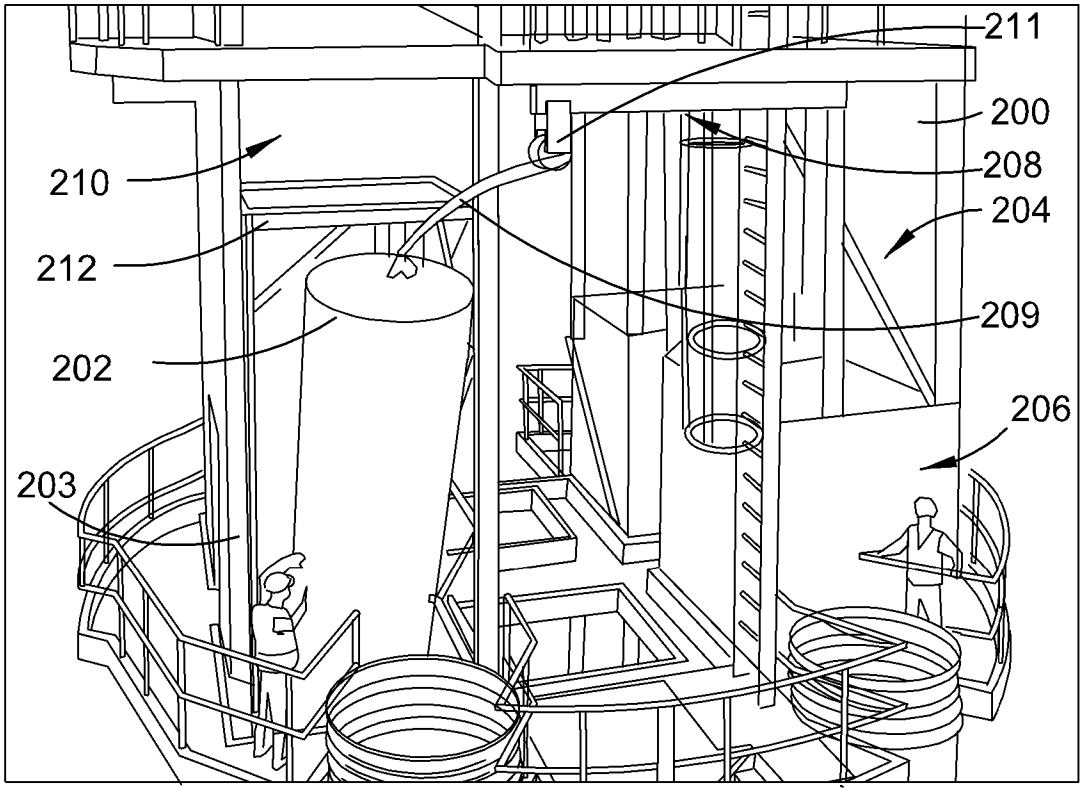
Figure 4:
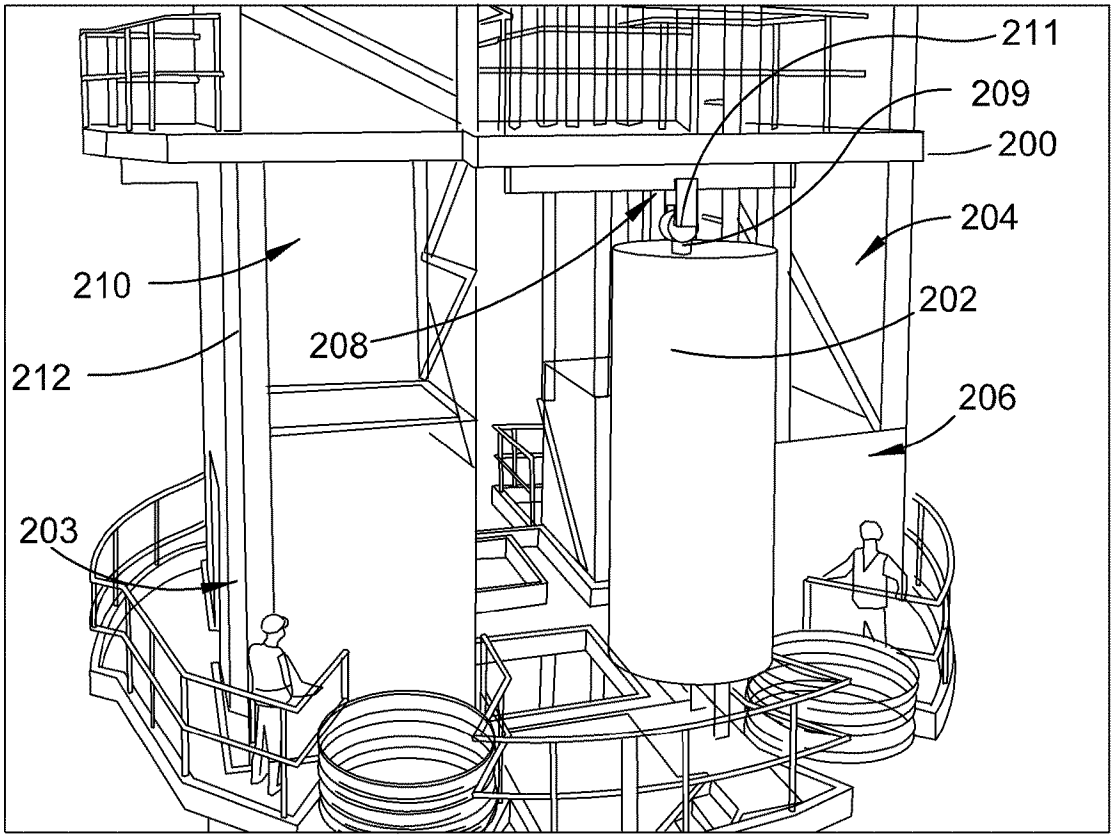

FIGS. 3 and 4 show the component or the material 202 as it is lifted by the lifting device 211 and moved towards the installation location 206.

Figure 5:
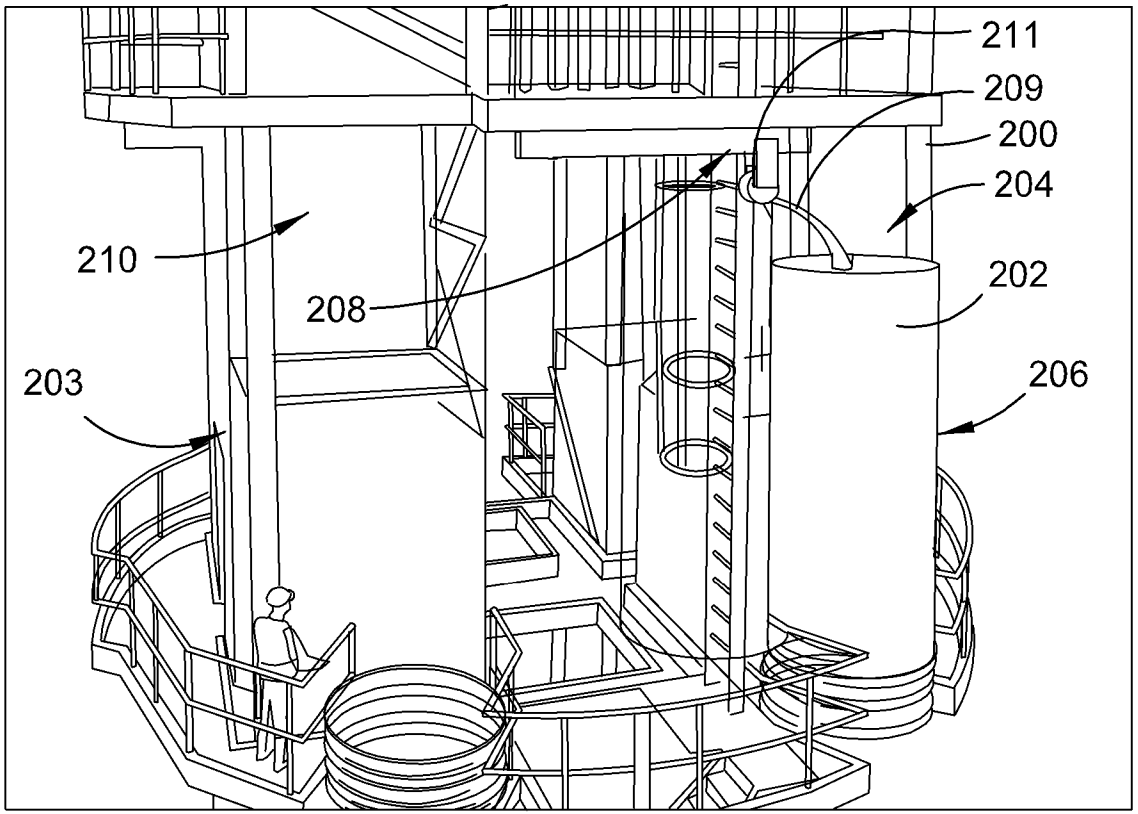

FIG. 5 shows the component or the material 202 at the installation location at which the component or the material 202 is decoupled from the monorail system and installed.

Figure 6:
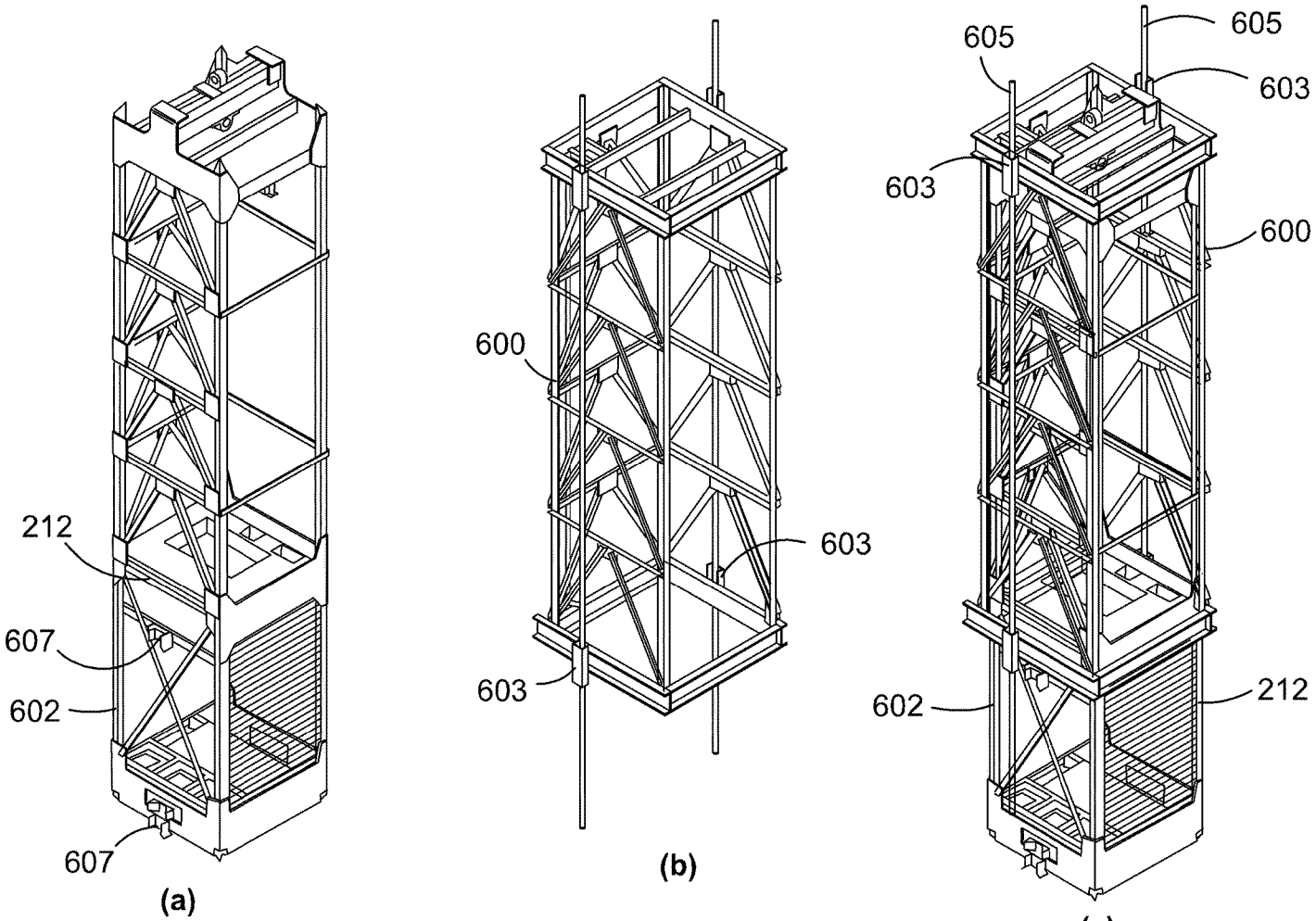
Figure 7:
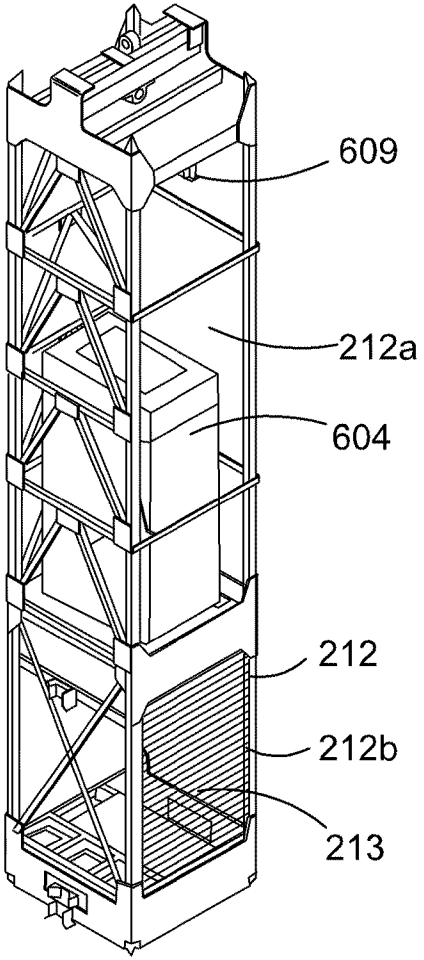

Referring now to FIGS. 6 and 7, the cage 212 is described in further detail. FIG. 6(*a*) shows the cage 212, FIG. 6(*b*) shows a cage holder, in the form of a crosshead 600, and FIG. 6(*c*) shows that crosshead 600 with the cage 212. The cage 212 is positioned within the crosshead 600 when the cage is lowered into the shaft. The shaft boring system is in this embodiment arranged such that the crosshead 600 arrives at a position above the work stage. The crosshead 600 remains stationary (e.g. is chaired against the work stage) at that position and the cage 212 moves out of the crosshead 600 to a lower position at which the component or the material is loaded onto the monorail system. FIG. 6(*a*) shows the cage 212 in a configuration in which the cage 212 has been moved to the lower position—for example, to a position below the crosshead 600, which is shown without the cage in FIG. 6(*b*).

The crosshead 600 provides cage guide means, in the form of runners 603, that run along the stage ropes 605 between the top of the mineshaft and the top of the shaft boring system. The crosshead 600, in effect, provides an interface between the cage 212 and the stage ropes 605 so that the cage 212 can be guided along the stage ropes 605 upwardly from the shaft boring system, and downwardly to the shaft boring system. The crosshead 600 stages against the mine shaft boring system when the cage 212 travels between levels of the mine shaft boring system—for example, to deliver components or materials to respective levels of the mine shaft boring system.

The cage 212 also includes guide means, in the form of channels 607, that guide the cage 212 along fixed guides within the shaft boring system. The cage 212 is therefore guided along its entire journey: from the top of the mineshaft to the mine shaft boring system, the cage 212 is received within the crosshead 600 and is thereby guided along stage ropes 605; and, from the top of the shaft boring system, into and through the shaft boring system, the cage 212 is provided with channels 607 that guide the cage 212 along fixed guides. Such an arrangement is described in greater detail in co-pending application AU 2013903212, the entirety of which is incorporated herein by reference.

The cage 212 includes an upper, cargo cage 212*a*, and a lower, personnel cage 212*b*. The lower personnel cage 212*b* comprises walls 602 that form an enclosure and comprise an access door 213. The cargo cage 212*a* is used for transporting materials and components along the mineshaft and within the shaft boring system. The personnel cage 212*b* is for transporting personnel along the mineshaft and within the mine shaft boring system. Importantly, as shown in FIG. 6(*c*), when the cage 212 is received in the crosshead 600, only the cargo cage 212*a* is within the crosshead 600. The personnel cage 212*b* is not contained within the crosshead 600 and instead depends downwardly from the crosshead 600.

Figure 8:
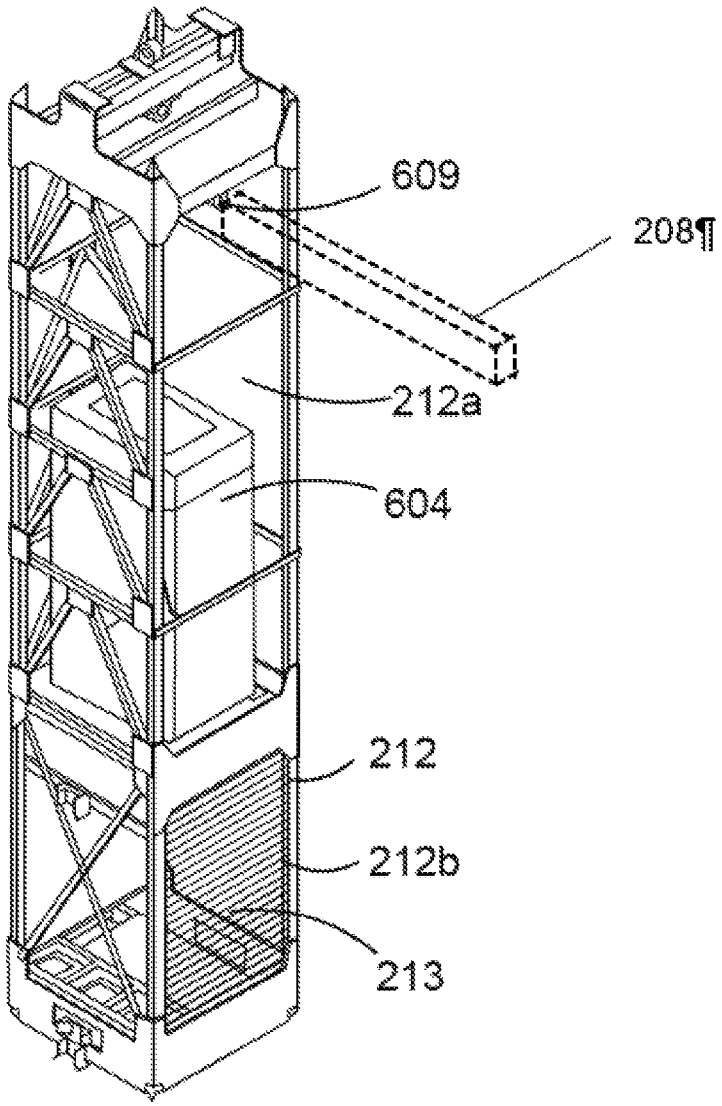

The cage 212*a* may further include a suspension element, in the form of a beam 609, by which components, materials or loads may be slung or suspended in the cage 212*a*. When the cage 212*a* arrives at the level in the mine shaft boring system at which the component or material is to be delivered, the beam 609, as shown in FIG. 8, may align with the monorail system 208. When aligned, the beam 609 and monorail 208 may form a substantially continuous elongate element of a transport system, thereby enabling a load to transition smoothly from the beam 609 directly onto the monorail 208, and from the monorail 208 onto the beam 609.

FIG. 7 shows the cage 212 in accordance with a further embodiment of the present invention. The cage 212, particularly the upper cargo cage 212*a*, is receivable within the crosshead 600. This configuration is shown in FIG. 6*c*, in which configuration the crosshead 600 with the cage 212 is lowered into the shaft. Referring again to FIG. 7, the cage 212 comprises an auxiliary cage 604 that is positioned within the cargo cage 212*a*. The auxiliary cage 604 may be used, for example to transport personnel.

From the present teachings, a person skilled in the art will appreciate that the cage and the cage holder, presently a crosshead, may be provided in a variety of forms and still accord with the present disclosure. Further, the crosshead may be arranged to receive any number of cages. Further, each cage may comprise a plurality of separated cages regions (for example a tandem cage or upper and lower cages 212*a*, and 604 in 212*b* as described above) and may also only partially enclose an interior portion. In further variations, the hoisting system may not comprise a crosshead and the crosshead with the cage may be replaced by any suitable type of cage that is arranged to carry the component or the material.

From the present teachings, the person skilled in the art will appreciate that the present system and method may provide and use a monorail system incorporated into the design of the shaft boring system: specifically, the monorail system is incorporated into the design of the Galloway. This facilitates the installation of specific services required in the formation of the shaft. The services may be installed in or onto a lining of the shaft. The services may comprise a pipe. The pipe may comprise a steel pipe. The pipe may comprise a vent duct.

Although the invention has been described with reference to particular examples, it will be appreciated by those skilled in the art that the invention may be embodied in many other forms. Further, the reference that is being made to International patent publication number WO 2011/000037A1 does not constitute an admission that this patent publication forms a part of the common general knowledge in Australia or in any other country.

The invention claimed is:

1. A method of moving and installing a component or a material within a level of a shaft boring system, the shaft boring system being positioned within a shaft, the method comprising the steps of:

lowering the component or the material into the shaft and to a particular level of the shaft boring system positioned within the shaft; thereafter coupling the component or the material to at least one track of a transport system within the particular level of the shaft boring system, the transport system comprising a network of tracks such that the component or material is deliverable to various locations within the particular level;

while the component or the material is coupled to the transport system, suspending the component or the material from the at least one track of the transport system within the particular level of the shaft boring system; and while the component or the material is suspended from the at least one track of the transport system, moving the component or the material within the particular level of the shaft boring system within the shaft along the transport system to a location where the component or the material is to be decoupled from the transport system; and installing the component or the material at the location within the shaft such that the component or the material is decoupled from the transport system when the component or the material is installed;

wherein the component is a component for the shaft boring system or the shaft and the material is a material for forming the shaft boring system or the shaft.

2. The method of claim 1 wherein the step of installing comprises installing the material or the component into or onto a lining of the shaft.

3. The method of claim 1 wherein the step of moving the component or the material comprises moving the component or the material within a work stage of the shaft boring system to the installation location of the shaft boring system positioned within a mine shaft.

4. The method of claim 1, wherein lowering the component or the material into the shaft comprises lowering the component or the material inside a cage into the shaft and to the particular level of the shaft boring system.

5. The method of claim 4, wherein the step of lowering the component or the material inside the cage comprises lowering a cage holder with the cage into the shaft to a position at which the cage holder is stationary and then lowering the cage from the cage holder to a position capable of allowing the component or the material to be accessed from the particular level of the shaft boring system.

6. The method of claim 4, wherein the cage comprises walls that at least partially enclose the component or the material.

7. The method of claim 4, wherein the cage is one of a plurality of cages.

8. The method of claim 7 wherein the plurality of cages comprises at least a first cage positioned over a second cage.

9. The method of claim 4, wherein the cage comprises a suspension element and the step of lowering the component or the material inside a cage comprises suspending the component or the material from the suspension element while lowering the component or the material inside the cage.

10. The method of claim 9, wherein the lowering the component to the particular level of the shaft boring system comprises lowering the cage until the suspension element aligns with the transport system.

11. The method of claim 1 comprising installing the transport system.

12. The method of claim 1 wherein the component or the material comprises a service component.

13. The method of claim 1 wherein the component or the material is capable of being used for installation or extension of services within the shaft boring system.

14. The method of claim 1 wherein the method is conducted during sinking of the shaft.

15. The method of claim 1 wherein the method is conducted during installation of the shaft boring system.

16. The method of claim 1 wherein the particular level of the shaft boring system is a work stage below an upper deck of the shaft boring system.

17. The method of claim 1 wherein the at least one track is a rail and the transport system is a monorail system.

18. The method of claim 17 wherein the monorail system is arranged to move the component or the material in a manner such that the component or the material is hanging below a portion of the rail monorail system during movement.

19. The method of claim 1 wherein the step of suspending the component or the material from the transport system comprises lifting the component or the material to a height that is capable of allowing the component or the material to move within the particular level of the shaft boring system.

* * * * *